US010946645B2

(12) United States Patent
Koehler et al.

(10) Patent No.: US 10,946,645 B2
(45) Date of Patent: Mar. 16, 2021

(54) PAUSE START-UP ROUTINE OF IMAGING DEVICE

(71) Applicant: Hewlett-Packard Development Company, L.P., Spring, TX (US)

(72) Inventors: Duane A Koehler, Vancouver, WA (US); Robert Yraceburu, Vancouver, WA (US); James M Brenner, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/609,526

(22) PCT Filed: May 1, 2017

(86) PCT No.: PCT/US2017/030459

§ 371 (c)(1),
(2) Date: Oct. 30, 2019

(87) PCT Pub. No.: WO2018/203876

PCT Pub. Date: Nov. 8, 2018

(65) Prior Publication Data

US 2020/0070500 A1 Mar. 5, 2020

(51) Int. Cl.

| | |
|---|---|
| ***B41J 2/365*** | (2006.01) |
| ***B41J 2/045*** | (2006.01) |
| ***B41J 2/315*** | (2006.01) |

(52) U.S. Cl.

CPC ..... *B41J 2/0454* (2013.01); *B41J 2/315* (2013.01); *B41J 2/365* (2013.01)

(58) Field of Classification Search

CPC ... B41J 2/0454; B41J 2/315; B41J 2/38; B41J 2/365; B41J 2/3556

See application file for complete search history.

(56) References Cited

U.S. PATENT DOCUMENTS

| | | | | |
|---|---|---|---|---|
| 4,910,528 | A | 3/1990 | Firl et al. | |
| 5,107,276 | A | 4/1992 | Kneezel et al. | |
| 6,296,350 | B1 | 10/2001 | Cornell et al. | |
| 7,055,931 | B2 | 6/2006 | West et al. | |
| 8,356,877 | B2 | 1/2013 | Lebron et al. | |
| 2010/0315452 | A1 | 12/2010 | Okada | |
| 2012/0134692 | A1 * | 5/2012 | Soda ..... | G03G 15/5004 399/44 |
| 2015/0160609 | A1 | 6/2015 | Seong et al. | |
| 2015/0198918 | A1 | 7/2015 | Sakaguchi et al. | |

FOREIGN PATENT DOCUMENTS

| | | |
|---|---|---|
| CN | 103969984 | 8/2014 |

* cited by examiner

*Primary Examiner* — Sharon Polk
(74) *Attorney, Agent, or Firm* — HP Inc. Patent Department

(57) ABSTRACT

Examples disclosed herein relate to an imaging device. Examples include a method for increasing the temperature of the imaging device by determining an internal temperature of the imaging device; determining if a start-up routine is to be initiated; pausing the start-up routine if the internal temperature is below a threshold temperature; and energizing at least one of a fan or heating element of the imaging device when the internal temperature is below the threshold temperature.

19 Claims, 3 Drawing Sheets

PAUSE START-UP ROUTINE OF IMAGING DEVICE

BACKGROUND

Various types of electronic devices perform a start-up routine to test and/or configure the device for use. In some examples, devices may perform a start-up routine when first powered on or when a power state of the device changes (for example from a sleep mode to a wake mode). Other devices may routinely perform a start-up routine.

BRIEF DESCRIPTION OF THE DRAWINGS

The following detailed description references the drawings, wherein.

DETAILED DESCRIPTION

Figure 1:
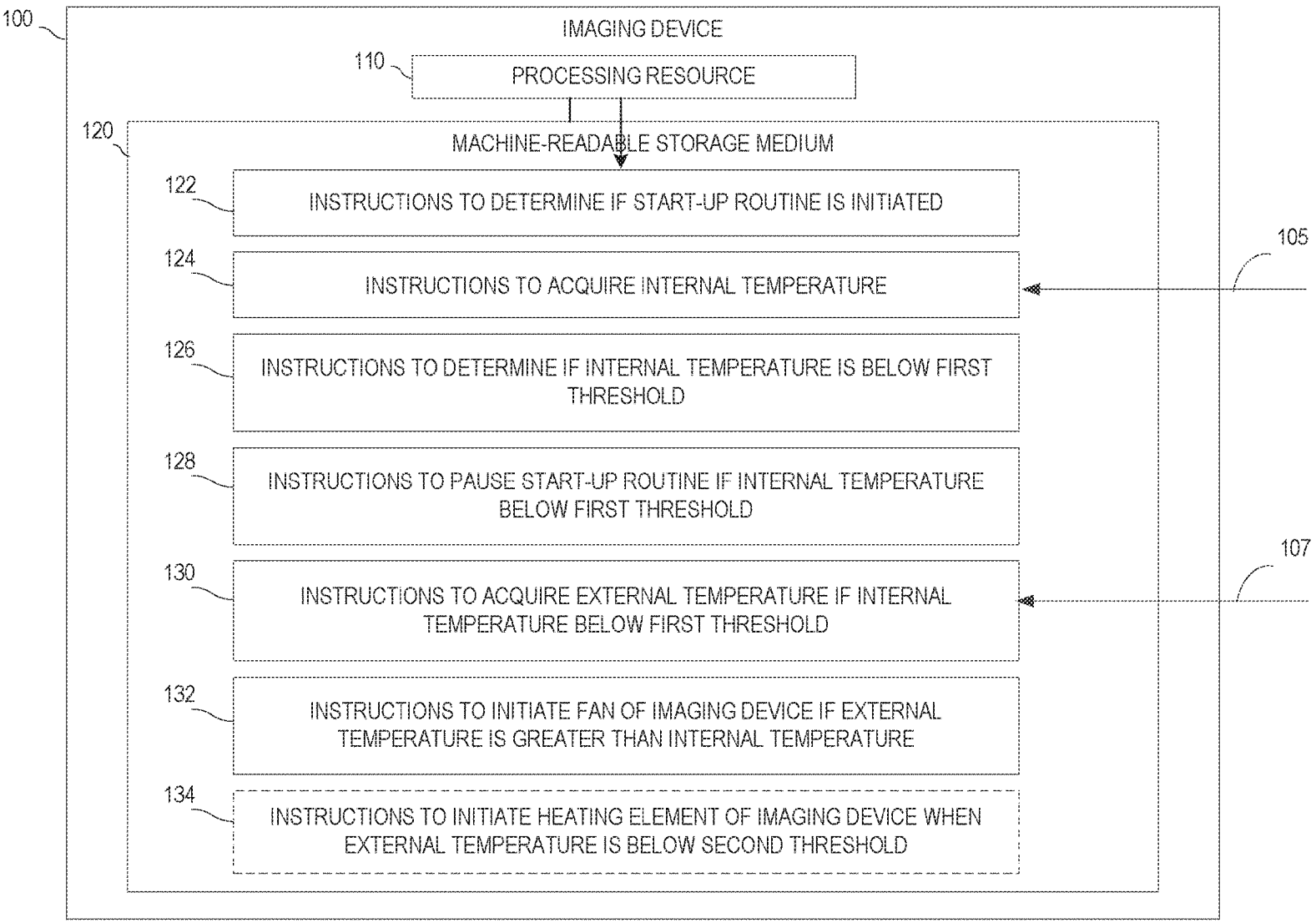
FIG. 1 is a block diagram of an example imaging device.

An "imaging device" may be a hardware device, such as a printer, multifunction printer (MFP), or any other device with functionalities to physically produce representation(s) (e.g., text, images, models, etc.) on a medium. In examples, a "medium" may include paper, photopolymers, thermopolymers, plastics, composite, metal, wood, or the like. In some examples, an MFP may be capable of performing a combination of multiple different functionalities such as, for example, printing, photocopying, scanning, faxing, etc. For example, the function within an imaging device may be to reboot the imaging device, troubleshoot the imaging device, upgrade firmware, retrieve consumable level information, clone features, adjust security settings, perform a test, retrieve a scan, execute a print request, clear an alert, etc.

An imaging device may be a laser imaging device including a photosensitive element to transfer a deposition material to a medium. In other examples, an imaging device may be an inkjet imaging device including a fluid ejection device to dispense a fluid (e.g., an ink, a developer fluid, etc.). In some such examples, a fluid ejection device may include one or more fluid ejection die. In some examples, a fluid ejection die may reciprocate across a span of a medium traveling through the imaging device. In other examples, a number of fluid ejection dies may be disposed in an array to cross a span or width of a medium traveling through the imaging device (i.e., a page-wide array).

In examples, an imaging device may perform a start-up routine to test and/or configure the imaging device for use. In some example imaging devices, a start-up routine may include a step or operation of purging of printing material. As used herein, "printing material" refers to any material which may be used by an imaging devices such as ink, toner, paper, etc. In such an example, an imaging device may purge a fluid (e.g., a shipping fluid, a developer fluid, an ink, etc.) contained in the imaging device during the start-up routine. It has been observed that if such purging occurs in too cold a temperature environment, the quality of a print job may decrease. For example, printing after or as part of a start-up routine in too cold an environment may result in artifacts appearing on the print job.

To address these issues, in the examples described herein, an imaging device may power on, energize, or initiate a fan and/or a heating element of the imaging device before a purging operation of the device to increase an internal temperature of the imaging device. In such examples, the imaging device may determine if an internal temperature of the imaging device is less than a threshold temperature. In examples, a start-up routine of the imaging device is paused or stopped before at least a purging operation. In examples, the imaging device may initiate a fan to circulate or transfer external air into a chassis of the imaging device if an external temperature is greater than an internal temperature. In other examples, the imaging device may initiate a heating element of the imaging device. In yet other examples, the imaging device may initiate a heating element and fan of the imaging device. In this manner, examples described herein may increase an internal temperature of an imaging device which may reduce the appearance of artifacts in a print job.

Referring now to the drawings, FIG. 1 is a block diagram of an example imaging device 100 to change an internal temperature of an imaging device. In the example of FIG. 1, imaging device 100 includes a processing resource 110 and a machine-readable storage medium 120 comprising (e.g., encoded with) instructions 122, 124, 126, 128, 130, 132, and 134 executable by processing resource 110. In some examples, storage medium 120 may include additional instructions. In some examples, instructions 122, 124, 126, and 128, 130, 132, 134, and any other instructions described herein in relation to storage medium 120, may be stored on a machine-readable storage medium remote from but accessible to imaging device 100 and processing resource 110 (e.g., via a computer network). In some examples, instructions 122, 124, 126, 128, 130, 132, and 134 may be instructions of a computer program, computer application ("app"), agent, or the like, of imaging device 100. In other examples, the functionalities described herein in relation to instructions 122, 124, 126, 128, 130, 132, and 134 may be implemented as engines comprising any combination of hardware and programming to implement the functionalities of the engines, as described below.

In examples described herein, a processing resource may include, for example, one processor or multiple processors included in a single imaging device (as shown in FIG. 1) or distributed across multiple imaging devices. A "processor" may be at least one of a central processing unit (CPU), a semiconductor-based microprocessor, a graphics processing unit (GPU), a field-programmable gate array (FPGA) to retrieve and execute instructions, other electronic circuitry suitable for the retrieval and execution of instructions stored on a machine-readable storage medium, or a combination thereof. Processing resource 110 may fetch, decode, and execute instructions stored on storage medium 120 to perform the functionalities described below. In other examples, the functionalities of any of the instructions of storage medium 120 may be implemented in the form of electronic circuitry, in the form of executable instructions encoded on a machine-readable storage medium, or a combination thereof.

As used herein, a "machine-readable storage medium" may be any electronic, magnetic, optical, or other physical storage apparatus to contain or store information such as executable instructions, data, and the like. For example, any machine-readable storage medium described herein may be any of Random Access Memory (RAM), volatile memory, non-volatile memory, flash memory, a storage drive (e.g., a hard drive), a solid state drive, any type of storage disc (e.g., a compact disc, a DVD, etc.), and the like, or a combination thereof. Further, any machine-readable storage medium described herein may be non-transitory.

In the example of FIG. 1, instruction 122 may determine if a start-up routine is to be initiated in imaging device 100. As used herein a 'start-up routine' refers to a routine that is executed by an imaging device when it is booted, changes a power state, or in response to an event. A routine may include one or more operations to be performed by the imaging device. In examples, an imaging device may be manually initiate a start-up routine or automatically initiate a start-up routine. In examples, an imaging device 100 may be manually initiate a start-up routine in response to a request to boot the imaging device. In such an example, imaging device 100 manually initiate a start-up routine in response to a signal received through a user interface (e.g., a switch, a button, a user-interface, etc.). In examples, an imaging device may be automatically initiate a start-up routine in response to an event. In some examples, the event may be when a power supply is provided to the imaging device. In other examples, the event may be when a power state of the imaging device changes (for example from a sleep mode to a wake mode, etc.). In yet another example, the event may be the receipt of a job request.

In instructions 124, an internal temperature 105 of imaging device 100 may be acquired. In examples, internal temperature 105 of imaging device 100 may be a temperature internal to a chassis of imaging device 100. In some examples, internal temperature 105 may be acquired from a temperature sensor inside the chassis of imaging device 100. In one such example, an internal temperature sensor may be disposed in a fluid ejection device of imaging device 100. In such an example, the temperature sensor may be a temperature sensing resistor. In another example, the temperature sensor may be a sensor to measure the temperature of a consumable coupled to imaging device 100. In examples, internal temperature 105 may be acquired as part of a start-up routine executed by imaging device 100. In other examples, internal temperature 105 may be acquired in response to a specific event. In one such example, internal temperature 105 may be acquired at a specific time. In another such example, internal temperature 105 may be acquired in response to change in a power state of imaging device 100 (e.g., from a sleep mode to a wake mode).

In the following discussion and in the claims, the term "couple" or "couples" is intended to include suitable indirect and/or direct connections. Thus, if a first component is described as being coupled to a second component, that coupling may, for example, be: (1) through a direct electrical or mechanical connection, (2) through an indirect electrical or mechanical connection via other devices and connections, (3) through an optical electrical connection, (4) through a wireless electrical connection, and/or (5) another suitable coupling. In contrast, the term "connect" or "connects" is intended to include direct mechanical and/or electrical connections.

In instructions 126, imaging device 100 may determine if internal temperature 105 is below a threshold temperature. In examples, the threshold temperature may be a specific temperature stored in imaging device 100. In other examples, the threshold temperature may be variable according to various characteristics of the imaging device and any consumable coupled thereto. As used herein, the term "consumable" refers to any printing material of an imaging device and any container to store such printing material. For example, a consumable may be a toner cartridge to couple to a laser imaging device or an ink cartridge to couple to an inkjet imaging device. In an example, the threshold temperature may be determined according to a characteristic of a consumable coupled thereto. In such an example, the threshold temperature may be determined according to the type (e.g., an ink cartridge or a toner cartridge) and size (e.g., a volume of toner or ink contained in a cartridge) of a consumable coupled to imaging device 100. In some such examples, the threshold temperature may be determined by imaging device 100. In other such examples, the threshold temperature may be acquired by imaging device 100. For example, the threshold temperature may be acquired from a consumable coupled to imaging device 100. In another such example, the threshold temperature may be acquired from a computing device coupled to imaging device 100. In some such examples, imaging device 100 may passively acquire (e.g., receive) or actively acquire (e.g., retrieve) the threshold temperature.

In instruction 128, the start-up routine of imaging device 100 may be paused if internal temperature 105 is below the threshold. As used herein, to "pause" a start-up routine of an imaging device is to pause or stop the start-up routine at any point before a step or operation of purging a printing material from the imaging device. In examples, the purging of printing material may be a purging of a fluid in an imaging device, such as an ink or a shipping fluid. In such an example, the purged fluid may be a shipping fluid disposed in a fluid ejection device of the imaging device 100 and the start-up routine may be invoked in response to powering the imaging device 100 for the first time. In another such example, the purged fluid may be an ink disposed in a fluid ejection device of imaging device 100 and the start-up routine may be invoked in response to an event, such as a change in power state. In such examples, the start-up routine may include a step to purge the shipping fluid from the fluid ejection device and replace it with an ink from a consumable coupled to the imaging device 100. In such an example, instructions 128 may pause the start-up routine before the purge step or operation if internal temperature 105 is less than the threshold temperature.

In instructions 130, an external temperature 107 of imaging device 100 may be acquired. In examples, external temperature 107 of imaging device 100 may be a temperature external to a chassis of the imaging device. In some examples, external temperature 107 may be acquired from a temperature sensor disposed on an outer surface of the chassis of imaging device 100. In other examples, external temperature 107 may be acquired from a temperature sensor inside the chassis of imaging device 100. In one such example, an external temperature sensor may be disposed on an internal surface of the chassis of imaging device 100. In examples, the external temperature sensor may be an ambient air temperature sensor of imaging device 100. In some examples, external temperature 107 may be acquired from the temperature sensor which acquires internal temperature 105 in operation 126.

In instructions 132, a fan of imaging device 100 may be initiated, powered on, or energized if external temperature 107 is great than an internal temperature 105. In such an example, the fan may circulate warmer external air into a chassis of imaging device 100 and may thereby increase an internal temperature of imaging device 100. In other words, in examples, the fan may exchange internal air of imaging device 100 with external air and may thereby increase an internal temperature of imaging device 100. In examples, the fan of imaging device 100 may be any fan of imaging device 100. In one example, the fan of imaging device 100 may be a fan of a dryer of imaging device 100. In another example, the fan may be an aerosol fan of imaging device 100.

In optional instructions 134, a heating element of imaging device 100 may be initiated, powered on, or energized when external temperature 107 is below a threshold temperature. In such examples, the threshold temperature may be the same threshold temperature described above with respect to instructions 126. In other examples, the threshold temperature may be a different threshold temperature from the threshold temperature of instructions 126. In such examples, the threshold temperature may be a specific temperature stored in imaging device 100. In other examples, the threshold temperature may be variable according to various characteristics of the imaging device and any consumable coupled thereto. For example, the threshold temperature may be determined according to a characteristic of a consumable coupled thereto. In such an example, the threshold temperature may be determined according to the type (e.g., an ink cartridge or a toner cartridge) and size (e.g., a volume of toner or ink contained in a cartridge) of a consumable coupled to imaging device 100. In some such examples, the threshold temperature may be determined by imaging device 100. In other such examples, the threshold temperature may be acquired by imaging device 100. For example, the threshold temperature may be acquired from a consumable coupled to imaging device 100. In another such example, the threshold temperature may be acquired from a computing device (e.g., a computer, a mobile phone, a tablet computer, a server, etc.) coupled to imaging device 100. In some such examples, imaging device 100 may passively acquire (e.g., receive) or actively acquire (e.g., retrieve) the threshold temperature.

In examples, the heating element may be any heating element of imaging device 100. In examples, the heating element may be a heating element of a fluid or powder handling system. In other examples, the heating element may be a space heating element inside a chassis of imaging device 100. In one example, the heating element may be a heating element of a dryer of imaging device 100. In other examples, the heating element may be a heating element of a warming tray of imaging device 100. In such an example, the warming tray of imaging device 100 may be a tray to receive a printing material, such as a medium (e.g., paper).

In examples, the fan and/or heating element may be turned off when the internal temperature of the imaging device has increased by a specific amount. In an example, the specific amount may be a range of five to fifteen degrees Celsius (5-15° C.). In other examples, the fan and/or heating element may be turned off when the internal temperature rises above a threshold temperature. In some examples, the threshold temperature may be the same temperature described with respect to instructions 126 or instructions 128. In other examples, the threshold temperature may be a different threshold temperature than that described with respect to instructions 126 and instructions 128. In such examples, the threshold temperature may be determined according to a characteristic of a consumable coupled thereto. In such an example, the threshold temperature may be determined according to the type (e.g., an ink cartridge or a toner cartridge) and size (e.g., a volume of toner or ink contained in a cartridge) of a consumable coupled to imaging device 100. In some such examples, the threshold temperature may be determined by imaging device 100. In other such examples, the threshold temperature may be acquired by imaging device 100. For example, the threshold temperature may be acquired from a consumable coupled to imaging device 100. In another such example, the threshold temperature may be acquired from a computing device coupled to imaging device 100. In some such examples, imaging device 100 may passively acquire (e.g., receive) or actively acquire (e.g., retrieve) the threshold temperature.

In some examples, instructions 122, 124, 126, 128, 130, 132, and 134 may be part of an installation package that, when installed, may be executed by processing resource 110 to implement the functionalities described herein in relation to instructions 122, 124, 126, 128, 130, 132, and 134. In such examples, storage medium 120 may be a portable medium, such as a CD, DVD, flash drive, or a memory maintained by an imaging device from which the installation package can be downloaded and installed. In other examples, instructions 122, 124, 126, 128, 130, 132, and 134 may be part of an application, applications, or component already installed on imaging device 100 including processing resource 110. In such examples, the storage medium 120 may include memory such as a hard drive, solid state drive, or the like. In some examples, functionalities described herein in relation to FIG. 1 may be provided in combination with functionalities described herein in relation to any of FIGS. 2-4C.

Figure 2:
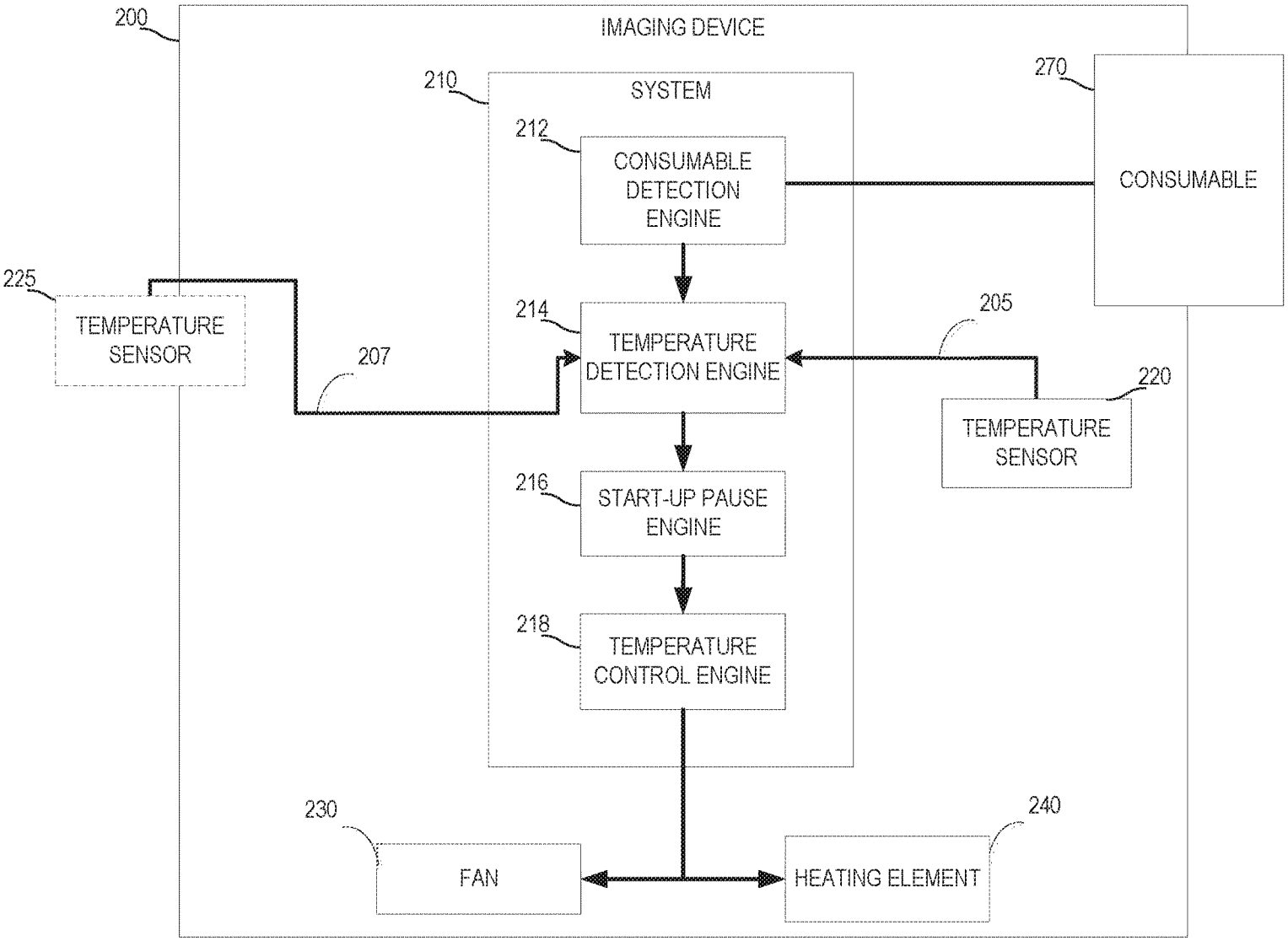
FIG. 2 is a block diagram of an example system to change a temperature of an imaging device.

FIG. 2 is a block diagram of an example system 210 to change a temperature of an imaging device 200. In some examples, system 210 may be disposed in an imaging device 200. In the example of FIG. 2, system 210 includes at least engines 212, 214, 216, and 218 which may be any combination of hardware and programming to implement the functionalities of the engines. In examples described herein, such combinations of hardware and programming may be implemented in a number of different ways. For example, the programming for the engines may be processor executable instructions stored on a non-transitory machine-readable storage medium and the hardware for the engines may include a processing resource to execute those instructions. In such examples, the machine-readable storage medium may store instructions that, when executed by the processing resource, implement engines 212, 214, 216, and 218. In such examples, system 210 may include the machine-readable storage medium storing the instructions and the processing resource to execute the instructions, or the machine-readable storage medium may be separate but accessible to system 210 and the processing resource.

In some examples, the instructions can be part of an installation package that, when installed, can be executed by the processing resource to implement at least engines 212, 214, 216, and 218. In such examples, the machine-readable storage medium may be a portable medium, such as a CD, DVD, or flash drive, or a memory maintained by an imaging device from which the installation package can be downloaded and installed. In other examples, the instructions may be part of an application, applications, or component already installed on system 210 including the processing resource. In such examples, the machine-readable storage medium may include memory such as a hard drive, solid state drive, or the like. In other examples, the functionalities of any engines of system 210 may be implemented in the form of electronic circuitry.

In the example of FIG. 2, consumable detection engine 212 may determine if a consumable 270 is coupled to imaging device 200. Consumable 270 may be any consumable as described above with respect to FIG. 1. In examples, consumable detection engine 212 may be coupled to any type of electrical or mechanical switch and/or interface to indicate the presence of consumable 270. In one such examples, consumable detection engine 212 may acquire an electrical signal to indicate a consumable is coupled to imaging device 200.

In examples, temperature detection engine 214 may acquire an internal temperature 205 of a housing or chassis of the imaging device 200. For examples, temperature detection engine 214 may acquire internal temperature 205 from a temperature sensor 220. In such examples, temperature detection engine 214 may determine if the internal temperature is less than a first threshold. As described above in relation to FIG. 1, temperature sensor 220 may be any temperature sensor of imaging device 200. In some examples, temperature detection engine 214 may acquire an external temperature 207 of imaging device 200. In one such examples, temperature detection engine 214 may acquire external temperature 207 from a temperature sensor 225. In such examples, temperature sensor 225 may be any temperature sensor to detect an external or ambient temperature as described above with respect to FIG. 1. In examples, temperature sensor 225 may be disposed on an internal surface or external surface of a chassis of imaging device 200. Although shown as separate temperature sensors, temperature sensor 220 and temperature sensor 225 may be the same sensor. In other examples, temperature detection engine 214 may acquire external temperature 207 from another device coupled thereto. For example, temperature detection engine 214 may acquire external temperature 207 from a device coupled thereto via a direct electrical connection or an indirect electrical connection.

In examples, start-up pause engine 216 may pause a start-up routine of imaging device 200 if internal temperature 205 is less than a threshold temperature. As described above with respect to FIG. 1, a start-up routine may be paused before reaching a step or operation to purge a printing material from imaging device 200. In some examples, start-up pause engine 216 may determine if a start-up routine is to be initiated in imaging device 200.

In examples, temperature control engine 218 may initiate at least one of a fan 230 or a heating element 240 if internal temperature 205 is less than the threshold temperature. As described above with respect to FIG. 1, fan 230 and heating element 240 may warm the inside of a housing or a chassis of imaging device 200. In such an example, system 210 may change a temperature of imaging device 200. In some examples, as described above, fan 230 may be a fan of a dryer of imaging device 200. In some examples, as described above, heating element 240 may be a heating element of a dryer of imaging device 200. In such an example, imaging device 200 may be an inkjet printing system with a fluid ejection device. In one such example, the fluid ejection device of imaging device 200 may include an array of fluid ejection dies disposed to span a width of a medium along a direction of travel of the medium through imaging device 200 (i.e., a page-wide array of fluid ejection dies). In another such example, the fluid ejection device of imaging device 200 may reciprocate across the width of the medium along the direction of travel of the medium through imaging device 200.

Figure 3:
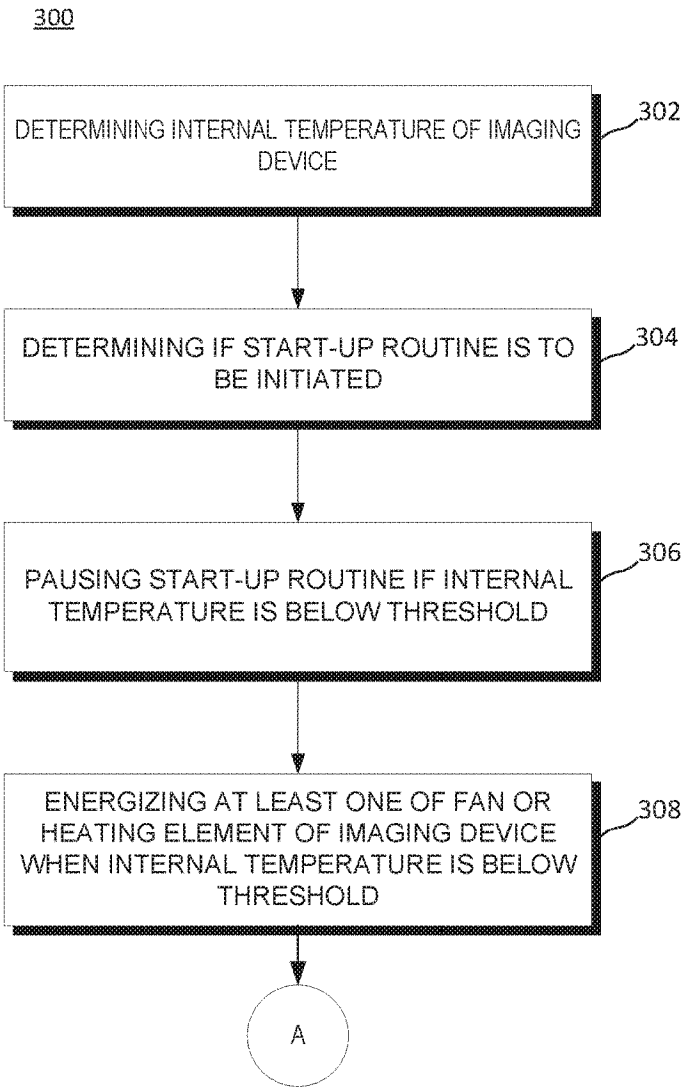
FIG. 3 is a flowchart of an example method for heating an imaging device.

FIG. 3 is a flowchart of an example method 300 for heating an imaging device. Although execution of method 300 is described below with reference to system 210 of FIG. 2 described above, other suitable systems for the execution of method 300 can be utilized (e.g., imaging device 100). Additionally, implementation of method 300 is not limited to such examples.

At 302 of method 300, temperature detection engine 214 may determine an internal temperature of imaging device 200.

At 304, start-up pause engine 216 may determine if a start-up routine is to be initiated in imaging device 200.

At 306, start-up pause engine 216 may pause the start-up routine if the internal temperature is below a first threshold.

At 308, temperature control engine 218 may initiate, power on, or energize at least one of fan 230 or heating element 240 of imaging device 200 when the internal temperature is below the first threshold.

Although the flowchart of FIG. 3 shows a specific order of performance of certain functionalities, method 300 is not limited to that order. For example, the functionalities shown in succession in the flowchart may be performed in a different order, may be executed concurrently or with partial concurrence, or a combination thereof. In some examples, functionalities described herein in relation to FIG. 3 may be provided in combination with functionalities described herein in relation to any of FIGS. 1-2 and 4A-4C.

Figure 4A:
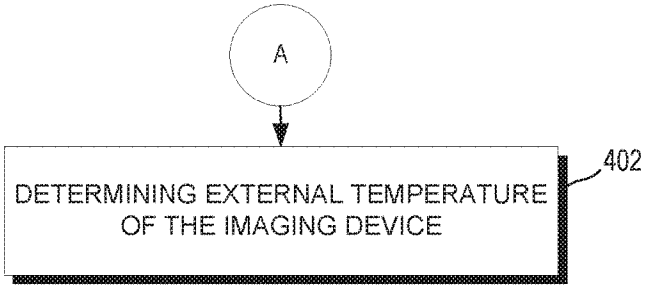
FIGS. 4A-4C are flowcharts of example method for heating an imaging device which may be incorporated into the flowchart of FIG. 3.
Figure 4B:
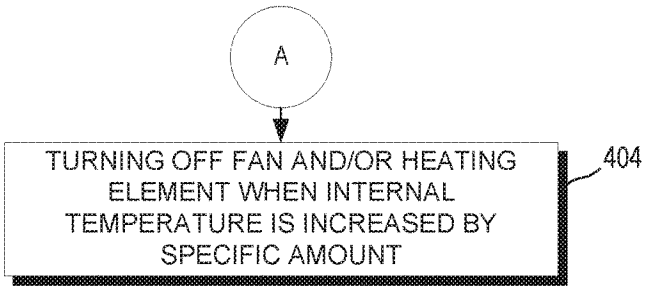
Figure 4C:
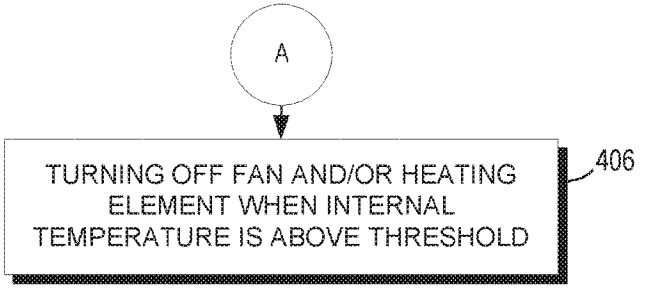

FIG. 4A-4C are flowcharts of an example method 400 for heating an imaging device which may be incorporated into the flowchart of FIG. 3. Although execution of the methods of FIGS. 4A-4C is described below with reference to system 210 of FIG. 2 and the flowchart of FIG. 3 described above, other suitable systems for the execution of the methods of FIGS. 4A-4C can be utilized (e.g., imaging device 100). Additionally, implementation of the methods of FIGS. 4A-4C are not limited to such examples.

At 402 of FIG. 4A, temperature detection engine 214 may determine an external temperature of imaging device 200. In some examples, temperature detection engine 214 may acquire external temperature 207 from temperature sensor 225. In other examples, temperature detection engine 214 may acquire external temperature 207 from another device coupled thereto, for example, via an indirect electrical connection. In an example, fan 230 may circulate external air into the imaging device when external temperature 207 is greater than internal temperature 205. In such a manner, as described above with reference to FIGS. 1 and 2, fan 230 may increase the temperature of imaging device as warmer external air is introduced into a chassis of imaging device 200.

At 404 of FIG. 4B, temperature control engine 218 may turn off fan 230 and/or heating element 240 when internal temperature 205 is increased by a specific amount. In an example, the specific amount may be a range of five to fifteen degrees Celsius (5-15° C.).

At 406 of FIG. 4C, temperature control engine 216 may turn off fan 230 and/or heating element 240 when internal temperature 205 is above a threshold temperature. In some examples, the threshold temperature may be the same temperature described with respect to 306. In other examples, the threshold temperature may be a different threshold temperature than that described with respect to 306.

Although the flowcharts of FIGS. 4A-4C shows a specific order of performance of certain functionalities, the flowcharts of FIGS. 4A-4C are not limited to that order. For example, the functionalities shown in succession in a flowchart may be performed in a different order, may be executed concurrently or with partial concurrence, or a combination thereof. In some examples, functionalities described herein in relation to FIGS. 4A-4C may be provided in combination with functionalities described herein in relation to any of FIGS. 1-3. All of the features disclosed in this specification (including any accompanying claims, abstract and drawings), and/or all of the steps of any method or process so disclosed, may be combined in any combination, except combinations where at least some of such features and/or steps are mutually exclusive.

What is claimed is:

1. A non-transitory machine-readable storage medium comprising instructions executable by a processing resource to:

determine if a start-up routine of an imaging device is to be initiated;

acquire an internal temperature of the imaging device;

determine if the internal temperature is below a first threshold;

pause the start-up routine if the internal temperature is below the first threshold;

acquire an external temperature of the imaging device if the internal temperature is below the first threshold; and initiate a fan of the imaging device to circulate external air into the imaging device if the internal temperature is below the first threshold and the external temperature is greater than the internal temperature.

2. The storage medium of claim 1, further comprising:

initiate a heating element of the imaging device when the external temperature is below a second threshold.

3. The storage medium of claim 1, wherein the start-up routine is paused before a purging of print material from the imaging device.

4. The storage medium of claim 1, wherein the fan is to circulate external air into a chassis of the imaging device if the internal temperature is below the first threshold and the external temperature is greater than the internal temperature.

5. The storage medium of claim 1, wherein the imaging device includes an ink ejection die.

6. An system to change a temperature of an imaging device, comprising:

a consumable detection engine to determine if a consumable is coupled to an imaging device;

a temperature detection engine to acquire an internal temperature of a housing of the imaging device, the temperature control engine to determine if the internal temperature is less than a first threshold;

a start-up pause engine to pause a start-up routine if the internal temperature is less than the first threshold; and a temperature control engine to initiate a fan of the imaging device to circulate external air into the imaging device if the internal temperature is less than the first threshold and an external temperature of the imaging device is greater than the internal temperature.

7. The system of claim 6, wherein the start-up pause engine is to pause the start-up routine before a purging of printing material from the imaging device.

8. The system of claim 6, wherein the imaging device includes an array of fluid ejection die to span a page width of a medium.

9. The system of claim 6, wherein the temperature control engine is to initiate a heating element of the imaging device if the internal temperature is less than the first threshold and the external temperature is less than a second threshold.

10. A method for heating an imaging device, comprising:

determining an internal temperature of the imaging device and an external temperature of the imaging device;

determining if a start-up routine is to be initiated;

pausing the start-up routine if the internal temperature is below a threshold temperature; and energizing a fan of the imaging device to circulate external air into the imaging device when the internal temperature is below the threshold temperature and the external temperature is greater than the internal temperature.

11. The method of claim 10, wherein the fan is disposed in a dryer of the imaging device.

12. The method of claim 10, wherein the start-up routine is paused before a purging of printing material from the imaging device.

13. The method of claim 10, further comprising:

turning off the fan when the internal temperature is increased by a specific amount.

14. The method of claim 10, further comprising:

turning off the fan when the internal temperature is above the threshold temperature.

15. The method of claim 10, wherein the imaging device includes a fluid ejection device.

16. The method of claim 10, further comprising:

energizing a heating element of the imaging device when the internal temperature is below the threshold temperature and the external temperature is below a second threshold temperature.

17. The method of claim 16, wherein the heating element is disposed in a dryer of the imaging device.

18. The method of claim 16, further comprising:

turning off the heating element when the internal temperature is increased by a specific amount.

19. The method of claim 16, further comprising:

turning off the heating element when the internal temperature is above the threshold temperature.

* * * * *